US005794599A

United States Patent [19]

Blumenstock

[11] Patent Number: 5,794,599

[45] Date of Patent: Aug. 18, 1998

[54] METHOD FOR CHECKING THE TIGHTNESS OF A TANK SYSTEM OF A VEHICLE HAVING AN INTERNAL COMBUSTION ENGINE

[75] Inventor: Andreas Blumenstock, Ludwigsburg, Germany

[73] Assignee: Robert Bosch GmbH, Stuttgart, Germany

[21] Appl. No.: 806,411

[22] Filed: Feb. 26, 1997

[30] Foreign Application Priority Data

Mar. 1, 1996 [DE] Germany ..... 196 07 771.0

[51] Int. Cl.[6] ..... F02M 33/02

[52] U.S. Cl. ..... 123/519; 123/520

[58] Field of Search ..... 123/516, 518, 123/519, 520, 198 D

[56] References Cited

U.S. PATENT DOCUMENTS 5,383,437 1/1995 Cook et al. ..... 123/520

OTHER PUBLICATIONS

"Tankdiagnose: Eine neue Methode zur sicheren Leckage-Erkennung", H. Stocker et al, 4. Aachener Kolloquium, Fahrzeug-und Motorentechnick, 1993.

*Primary Examiner*—Thomas N. Moulis
*Attorney, Agent, or Firm*—Walter Ottesen

[57] ABSTRACT

The invention is directed to a method for checking the tightness of a tank system of an internal combustion engine having an intake pipe. The tank system includes: a fuel tank wherein fuel vapor forms, a regeneration valve connected to the intake pipe; an adsorption filter connected between the regeneration valve and the fuel tank; the regeneration valve being movable between a closed position and an open position wherein the fuel vapor is drawn by suction into the intake pipe; the adsorption filter having a venting line; and, a shutoff valve for the venting line and being movable between a first position wherein the venting line is closed off pressure tight and a second position wherein the venting line is open to the adsorption filter; and, a pump for generating a diagnostic overpressure in the tank system. The method includes the steps of: generating a diagnostic overpressure in the tank system with the regeneration valve in the closed position and the shutoff valve in the first position; first moving the regeneration valve to the open position; measuring the pressure in the tank system; and, then switching the shutoff valve into the second position when the pressure in the tank system corresponds essentially to atmospheric pressure.

6 Claims, 2 Drawing Sheets

Pulse-Duty Factor (TEV)

Open State of Shutoff Valve
Closed
Open $P_{Tank}$
20hPa
-30hPa t
$t_1$
$t_{1a}$
$t_2$
$t_3$

METHOD FOR CHECKING THE TIGHTNESS OF A TANK SYSTEM OF A VEHICLE HAVING AN INTERNAL COMBUSTION ENGINE

BACKGROUND OF THE INVENTION

Starting in mid-1996, the California Environmental Authority (CARB) has required an onboard diagnosis to check the operability of vehicle systems. In this connection, especially a test as to the tightness of the tank system should be performed with onboard equipment.

A tank system for a vehicle with an internal combustion engine includes essentially a fuel tank, a regeneration valve connected to the intake pipe of the engine and an adsorption filter mounted between the fuel tank and the regeneration valve. Fuel vapor is drawn by suction into the intake pipe via the adsorption filter when the regeneration valve is open.

U.S. Pat. No. 5,383,437 as well as an article entitled "Tankdiagnose: Eine neue Methode zur sicheren Leckage-Erkennung", published in the publication for the "4. Aachener Kolloquium über Fahrzeug- und Motorentechnik 1993" both disclose a method for testing the tightness of a tank system of a vehicle having an internal combustion engine. In this method, and for a closed regeneration valve, a diagnostic overpressure is generated in the tank system by means of a pump and thereafter, in the quasi-stationary state, a pressure drop is repeatedly compensated by the actuation of the pump. This pressure drop adjusts in the tank system when there is a leak present after a specific time and the conclusion is drawn that there is a leak in the tank system from the time which has elapsed between two pump actuations; that is, the time between the two pump strokes. The time elapsed between the two pump strokes is a direct criterion for the leakage of the system. After the conclusion of the tightness check, the overpressure present in the tank system must be reduced. This takes place pursuant to the known method in that the pump is deactivated and simultaneously the shutoff means is opened so that the overpressure of the tank system escapes into the atmosphere.

It is disadvantageous in this type of overpressure reduction that a completely saturated adsorption filter is, to some extent, inversely scavenged as the overpressure escapes into the atmosphere so that carbon molecules can enter into the atmosphere. This means not only an unwanted burden on the environment (which is precisely the condition which the tank system equipped with the tank-venting arrangement is intended to avoid) but also a most annoying odor to the person operating the vehicle.

SUMMARY OF THE INVENTION

It is an object of the invention to provide a method for testing the tightness of a tank system of a vehicle having an internal combustion engine. It is another object of the invention to provide a method of the kind referred to above which is improved especially in that an escape of fuel vapors into the atmosphere is prevented at the completion of the tightness test. It is therefore also an object to prevent toxic carbon molecules from entering the atmosphere as a consequence of carrying out the method.

The method of the invention is for checking the tightness of a tank system of an internal combustion engine having an intake pipe. The tank system includes: a fuel tank wherein fuel vapor forms, a regeneration valve connected to the intake pipe; an adsorption filter connected between the regeneration valve and the fuel tank; the regeneration valve being movable between a closed position and an open position wherein the fuel vapor is drawn by suction into the intake pipe; the adsorption filter having a venting line; and, shutoff means for the venting line and the shutoff means being movable between a first position wherein the venting line is closed off pressure tight and a second position wherein the venting line is open to the adsorption filter; and, pump means for generating a diagnostic overpressure in the tank system. The method includes the steps of: generating a diagnostic overpressure in the tank system with the regeneration valve in the closed position and the shutoff means in the first position; first moving the regeneration valve to the open position; measuring the pressure in the tank system; and, then switching the shutoff means into the second position when the pressure in the tank system corresponds essentially to atmospheric pressure.

It is especially advantageous that the diagnostic overpressure is reduced after ending the tightness test by opening the regeneration valve. In this way, the diagnostic overpressure is, to a certain extent, drawn off by suction into the intake pipe thereby avoiding (when the adsorption filter is saturated) that fuel vapors and therefore toxic carbon molecules escape into the atmosphere. With the method of the invention, not only is the entire vehicle more compatible with the environment but also the annoyance of the unwanted odor is significantly reduced.

Thus, it is, for example, advantageous that the pressure in the tank system is determined by means of a pressure sensor, which measures the pressure difference between the pressure present in the tank and atmospheric pressure. The pressure sensor is mounted in the fuel tank. In this way, only a few changes are needed in conventional tank systems in order to carry out the method of the invention.

It is however also possible that the pressure in the tank system is determined via the fuel vapor drawn off by suction and/or the diagnostic overpressure and/or the fill level of the fuel tank.

The pressure is preferably computed in a computer unit from this data. The pressure can, however, also be estimated in an evaluation device, for example, a circuit arrangement or the like.

In this type of pressure determination, it is advantageous that, for an existing tank system, practically no changes are necessary in order to be able to carry out the method because the pressure determination is shifted to the data processing level which is carried out by existing computers (engine control and the like).

Preferably, the regeneration valve is a tank-venting valve and the adsorption filter is an active charcoal filter.

BRIEF DESCRIPTION OF THE DRAWINGS

The invention will now be described with reference to the drawings wherein.

DESCRIPTION OF THE PREFERRED EMBODIMENTS OF THE INVENTION

The basic idea of the present invention is to improve a method for testing the tightness of a tank system of a vehicle having an internal combustion engine wherein the tightness check is performed via an overpressure built up in the tank system. The method is improved in that after completing the tightness test, the overpressure is reduced so that the overpressure is not released into the atmosphere but instead is conducted to the engine. In this way, a burden to the environment because of exiting toxic carbon molecules is avoided.

The method of the invention for testing the tightness of a tank system of a vehicle having an internal combustion engine is explained with reference to FIG. 2 and the time-dependent quantities presented in FIGS. 1*a*, 1*b* and 1*c* as delineated above.

Figure 2:
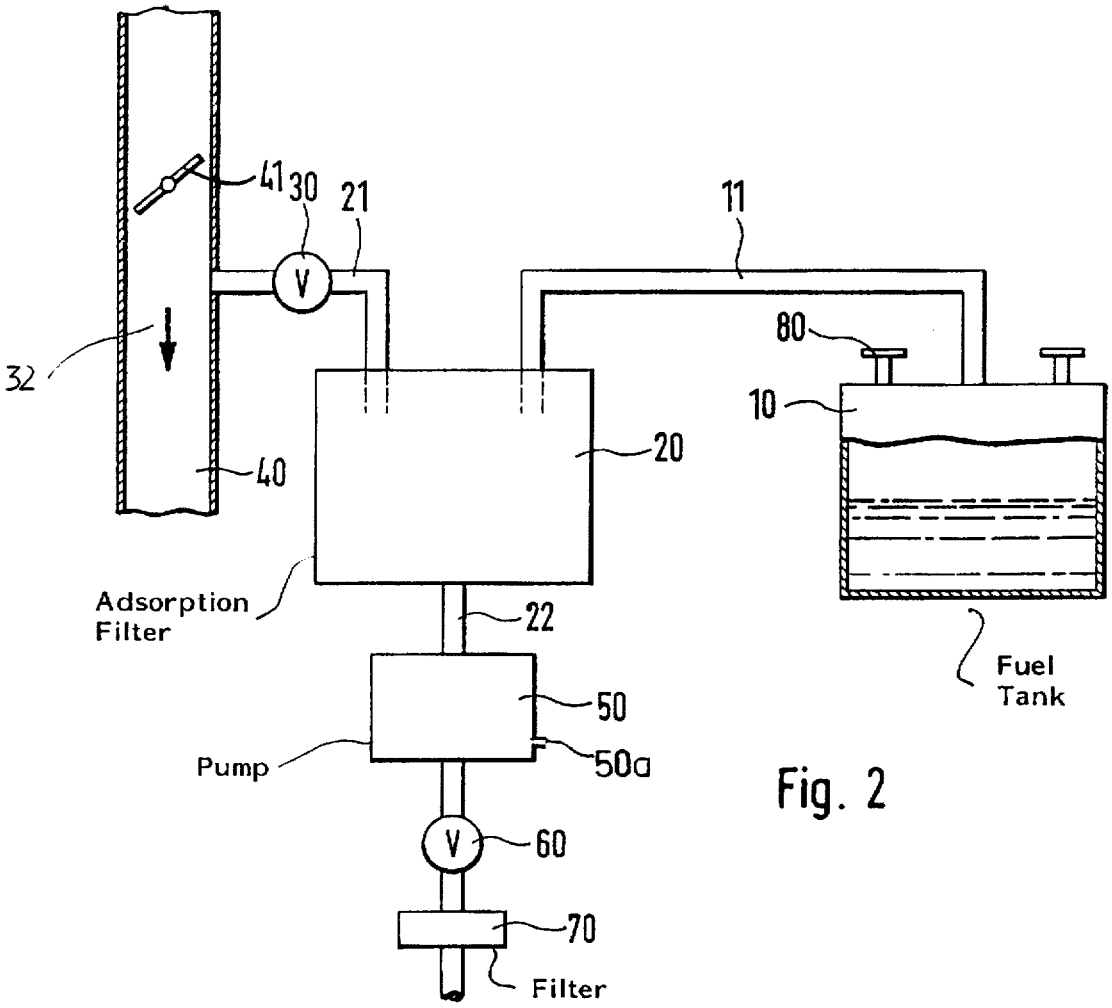

Referring to FIG. 2, a tank system of an internal combustion engine includes a fuel tank 10 which is connected via a line 11 to an adsorption filter 20 such as an active-charcoal filter. The adsorption filter 20 is connected via a further line 21 and a regeneration valve 30 (such as a tank-venting valve) to the intake pipe 40 of an engine (not shown). The inlet of the line 21 into the intake pipe 40 is arranged behind a throttle flap 41. The direction of flow is indicated by arrow 32 in FIG. 2.

The adsorption filter 20 further includes an additional line 22 which connects the adsorption filter 20 with the atmosphere via a pump 50, shutoff means 60 (for example, a shutoff valve) and a filter 70 for venting the adsorption filter 20.

To regenerate the adsorption filter 20, the tank-venting valve 30 is opened so that the fuel vapors, which are adsorbed in the adsorption filter 20 can be scavenged into the intake channel 40 of the engine. This regeneration phase is shown in FIGS. 1*a* to 1*c* and takes place in the time interval before the time $t_1$ and after time point $t_3$.

The procedure for testing the tightness of the tank system will now be explained.

In the time interval between $t_1$ and $t_2$ (FIG. 1), a diagnostic overpressure is generated in the tank system with the regeneration valve 30 closed and the shutoff valve 60 closed. The overpressure is generated by means of the pump 50 by drawing in air through an inlet 50*a*, which communicates with the atmosphere, and compressing this air. The pressure in the tank system compared to atmospheric pressure is, for example, determined by a pressure sensor 80 which is mounted on the fuel tank and measures the pressure difference between the pressure present in the fuel tank 10 and the atmospheric pressure.

As soon as the pressure has increased over a certain pregiven value ($t_{1a}$), the pressure drop which adjusts in the time interval $t_{1a}$ to $t_2$ is compensated in the quasi steady-state by actuating the pump 50. From the time, which has elapsed between pump actuations (that is, the time which is necessary with repeated pumping to counter a pressure drop below a pregiven threshold), a conclusion is drawn as to the presence of a leak and, if necessary, as to its size as known, for example, from U.S. Pat. No. 5,383,437 incorporated herein by reference and from the article entitled "Tankdiagnose: Eine neue Methode zur sicheren Leckage-Erkennung", published in the seminar publication for the "4. Aachener Kolloquium über Fahrzeug- und Motorentechnik 1993".

After completing the tightness test, the diagnostic overpressure in the tank system must be reduced in the time interval between the time $t_2$ and the time $t_3$ (FIG. 1).

Figures 1A, 1B, 1C:
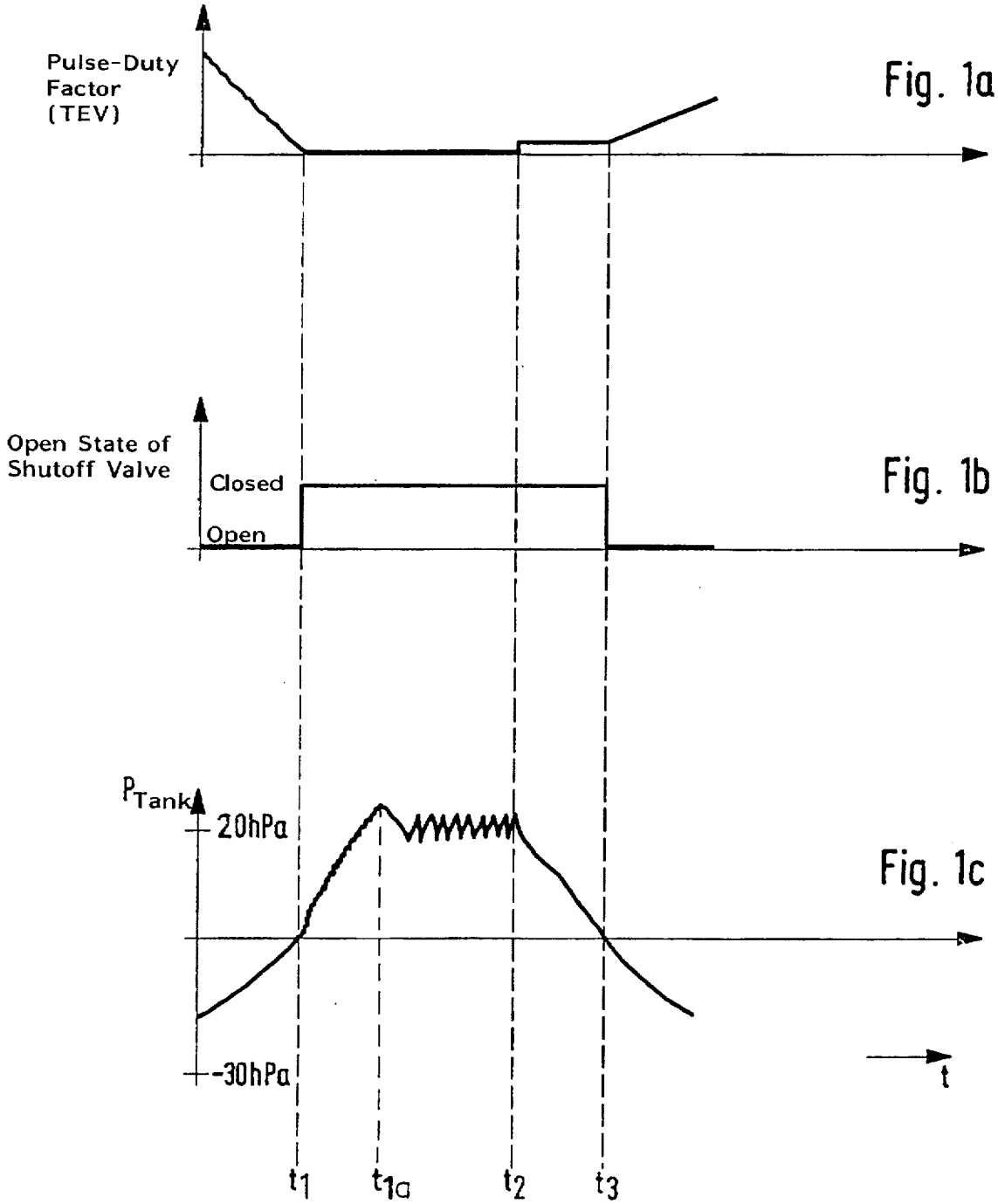
FIG. 1*a* is a plot of the pulse-duty factor of the tank-venting valve as a function of time.
FIG. 1*b* is a plot of the open/closed state of the shutoff valve plotted as a function of time.
FIG. 1*c* is a trace of the pressure present in the tank system compared to atmospheric pressure as a function of time; and, FIG. 2 is a schematic block diagram of an arrangement for testing the tightness of a tank system of a vehicle having an internal combustion engine.

The foregoing takes place in that first the regeneration valve 30 (tank-venting valve) is opened while the shutoff valve 60 is closed (see FIGS. 1*a* and 1*b*). Simultaneously thereto, the pressure in the tank system is detected by means of the pressure sensor 80 and the shutoff valve 60 is only opened when a pressure has adjusted in the tank system corresponding essentially to the ambient pressure. In this way, the condition is obtained that the overpressure is reduced by an induction into the intake channel 40 of the engine whereby an escape of toxic carbon molecules into the atmosphere is prevented. These toxic carbon molecules are, for example, present in a saturated adsorption filter 20.

To determine the pressure in the tank system, it is also possible to determine the pressure by the following: the fill level of the fuel tank 10, the diagnostic overpressure which is pregiven essentially by the pump capacity, and the fuel quantity drawn off by suction. This fuel quantity is known from the intake pipe pressure and therefore from the pressure difference at the regeneration valve 30 (tank-venting valve) and from the throughflow characteristic of the regeneration valve 30. The determination takes place preferably in a computer unit (not shown) or in a special circuit unit which can be configured using analog, digital or hybrid technology.

Finally, it is also possible to estimate the pressure in an evaluation device from the following: the data as to the fill level of the fuel tank 10, the diagnostic overpressure and the fuel vapor quantity drawn off by suction. The evaluation device can likewise be a circuit unit configured in analog, digital or hybrid circuitry.

It is understood that the foregoing description is that of the preferred embodiments of the invention and that various changes and modifications may be made thereto without departing from the spirit and scope of the invention as defined in the appended claims.

What is claimed is:

1. A method for checking the tightness of a tank system of an internal combustion engine having an intake pipe, the tank system including: a fuel tank wherein fuel vapor forms, a regeneration valve connected to said intake pipe; an adsorption filter connected between said regeneration valve and said fuel tank; said regeneration valve being movable between a closed position and an open position wherein said fuel vapor is drawn by suction into said intake pipe; said adsorption filter having a venting line; and, shutoff means for said venting line and said shutoff means being movable between a first position wherein said venting line is closed off pressure tight and a second position wherein said venting line is open to said adsorption filter; and, pump means for generating a diagnostic overpressure in said tank system; the method comprising the steps of:

generating a diagnostic overpressure in said tank system with said regeneration valve in said closed position and said shutoff means in said first position;

first moving said regeneration valve to said open position;

measuring the pressure in said tank system; and, then switching said shutoff means into said second position when said pressure in said tank system corresponds essentially to atmospheric pressure.

2. The method of claim 1, wherein said pressure in said tank system is determined with a pressure sensor mounted in said fuel tank; and, said pressure sensor is adapted to measure the pressure difference between atmospheric pressure and the pressure in said fuel tank.

3. The method of claim 1, further comprising the step of determining said pressure in said tank system via at least one of the following: the quantity of said fuel vapor drawn into said intake pipe via suction; the diagnostic overpressure; and, the fill level of the fuel in said fuel tank.

4. The method of claim 3, further comprising the step of computing said pressure in said tank system in a computation unit.

5. The method of claim 3, further comprising the step of computing said pressure in said tank system in an evaluation unit.

6. The method of claim 1, wherein said regeneration valve is a tank-venting valve and said adsorption filter is an active charcoal filter.

* * * * *